US009228526B2

(12) United States Patent
Nishimura

(10) Patent No.: US 9,228,526 B2
(45) Date of Patent: Jan. 5, 2016

(54) FUEL INJECTION CONTROLLER

(71) Applicant: DENSO CORPORATION, Kariya, Aichi-pref. (JP)

(72) Inventor: Toshio Nishimura, Anjo (JP)

(73) Assignee: DENSO CORPORATION, Kariya (JP)

( * ) Notice: Subject to any disclaimer, the term of this patent is extended or adjusted under 35 U.S.C. 154(b) by 306 days.

(21) Appl. No.: 13/939,538

(22) Filed: Jul. 11, 2013

(65) Prior Publication Data

US 2014/0020661 A1 Jan. 23, 2014

(30) Foreign Application Priority Data

Jul. 18, 2012 (JP) ..... 2012-159738

(51) Int. Cl.

| | |
|---|---|
| ***F02M 51/00*** | (2006.01) |
| ***F02D 41/30*** | (2006.01) |
| ***F02D 41/20*** | (2006.01) |
| *F02D 41/24* | (2006.01) |

(52) U.S. Cl.

CPC ..... *F02D 41/3005* (2013.01); *F02D 41/20* (2013.01); *F02D 41/2438* (2013.01); *F02D 41/2467* (2013.01); *F02D 2041/2058* (2013.01)

(58) Field of Classification Search

CPC ..... F02D 41/3005; F02D 41/20; F02D 2041/2058; F02D 41/2467

USPC ..... 123/478, 480, 490

See application file for complete search history.

(56) References Cited

U.S. PATENT DOCUMENTS

| | | | | |
|---|---|---|---|---|
| 6,571,773 | B1 * | 6/2003 | Yamakado et al. | 123/490 |
| 6,766,789 | B2 * | 7/2004 | Yamakado et al. | 123/490 |
| 7,966,871 | B2 * | 6/2011 | Perryman et al. | 73/114.45 |
| 2011/0222202 | A1 | 9/2011 | Onda et al. | |
| 2012/0180762 | A1 * | 7/2012 | Casasso | 123/472 |
| 2012/0318883 | A1 * | 12/2012 | Kusakabe et al. | 239/1 |
| 2012/0323468 | A1 | 12/2012 | Miyaura et al. | |

FOREIGN PATENT DOCUMENTS

| | | |
|---|---|---|
| EP | 0 427 127 | 5/1991 |
| JP | 2007-66978 | 3/2007 |
| JP | 2009-250175 | 10/2009 |
| JP | 2009-296721 | 12/2009 |
| JP | 2010-73705 | 4/2010 |
| JP | 2010-532448 | 10/2010 |
| JP | 2010-265877 | 11/2010 |

OTHER PUBLICATIONS

Office Action (2 pages) dated Aug. 5, 2014, issued in corresponding Japanese Application No. 2012-159738 and English translation (2 pages).

* cited by examiner

*Primary Examiner* — Hai Huynh
(74) *Attorney, Agent, or Firm* — Nixon & Vanderhye PC

(57) ABSTRACT

A fuel injection controller includes a transistor downstream of a coil of a fuel injector, two transistors applying a source voltage to an upstream of the coil, a diode refluxing an electric current to the coil from a ground, and a Zener diode provided to promptly consume the counter electromotive force generated in the coil when one of the transistors is turned OFF and the transistor is turned OFF, after an injector-drive-period of the fuel injector is terminated. When a microcomputer measures an injector current "I" decreasing from a time of the termination of an injector-drive-period, a drive control circuit delays an OFF time of the transistor relative to a time of a termination of an injector-drive-period, whereby the injector current "I" decreases gradually.

3 Claims, 5 Drawing Sheets

FUEL INJECTION CONTROLLER

CROSS-REFERENCE TO RELATED APPLICATION

This application is based on Japanese Patent Application No. 2012-159738 filed on Jul. 18, 2012, the disclosure of which is incorporated herein by reference.

TECHNICAL FIELD

The present disclosure relates to a fuel injection controller which drives an electromagnetic-type fuel injector. The fuel injector is opened when a coil is energized.

BACKGROUND

An electromagnetic-type fuel injector having a coil is well known as a fuel injector injecting fuel into a cylinder of an internal combustion engine. When the coil is energized, the fuel injector is opened to inject the fuel into the cylinder. A fuel injection controller drives such a fuel injector and controls the fuel injection to the internal combustion engine. Specifically, the fuel injection controller controls an energization start time at which an energization operation is started for energizing the coil. Further, the fuel injection controller controls a drive time period during which the energization operation has been conducted since the energization start time. Thereby, the fuel injection controller controls a fuel injection period and a fuel injection quantity.

Also, in this kind of fuel injection controller, a characteristic of a fuel injector is detected and the drive time period of the injector may be corrected according to the detected characteristic of the fuel injector.

JP-2010-532448A (EP-2174046A1) shows a method for detecting a characteristic of a fuel injector. In this method, an electric current flowing through the coil, which is decreasing from a starting time of valve-close period of an electromagnetic valve, is differentiated. The electromagnetic valve corresponds to a fuel injector and the starting time of valve-close period corresponds to an end time of the drive time period. Based on the derivative value of the electric current, a valve-close time of the injector is detected and a time period from the start time of the valve-close period until the valve-close time is computed as the characteristic of the fuel injector. Furthermore, based on the computed time period for valve-closing, a drive controlling duration, which corresponds to the drive time period, is computed so that a desired injection quantity is obtained.

Generally, in a fuel injection controller, in order to close a fuel injector immediately after the drive time period for the fuel injector is terminated, a counter-electromotive force generated by an energy accumulated in the coil is promptly consumed by the extinction, whereby the electric current flowing through a coil is rapidly decreased. The electric current flowing through the coil is referred to as an injector current.

For this reason, regarding such a fuel injection controller, when the method shown in JP-2010-532448A (EP-2174046A1) is applied to analyze a decreasing waveform of the injector current, it is likely that a sufficient detection accuracy may not be obtained in detecting the characteristic of the fuel injector because a decreasing period of the injector current is short. That is, a time length of the waveform of the injector current is short. The waveform of the injector current does not vary a lot according to a difference in characteristic of the fuel injector.

It is conceivable that an interval of an A/D conversion (analog-to-digital conversion) of the injector current is made shorter to improve the detection accuracy of the current waveform. However, in this method, an A-D converter of high-speed operation is necessary, which increases its cost.

SUMMARY

It is an object of the present disclosure to provide a fuel injection controller which improves a detection accuracy of a characteristic of a fuel injector.

The fuel injection controller has a downstream switching element provided in an energizing path for supplying an electric current to a coil of a fuel injector. The downstream switching element is provided downstream of the coil in series. The fuel injection controller has an electric-power supplying portion which can switch between a power applying condition in which a source voltage is applied to an upstream of the coil in the energizing path and a non-power applying condition in which no source voltage is applied to the upstream of the coil in the energizing path.

Furthermore, the fuel injection controller has a refluxing portion for refluxing the electric current from a downstream of the downstream switching element to an upstream of the coil when the electric-power supplying portion switches from the power applying condition to the non-power applying condition while the downstream switching element is ON; an arc extinguishing portion for extinguishing a counter electromotive force generated in the coil when the electric-power supplying portion switches from the power applying condition to the non-power applying condition and when the downstream switching element is turned OFF from ON; an establishing portion for establishing an injector-drive-period of the fuel injector; and a drive control portion for controlling the electric-power supplying portion and the downstream switching element.

The drive control portion controls the electric-power supplying portion to be the power applying condition when the injector-drive-period is started, and the drive control portion turns ON the downstream switching element for starting an energization of the coil to open the fuel injector. The drive control portion controls the electric-power supplying portion to be the non-power applying condition when the injector-drive-period is terminated. The drive control portion turns OFF the downstream switching element for terminating the energization of the coil to close the fuel injector.

Then, an arc extinguishing portion extinguishes a counter electromotive force generated in the coil when the electric-power supplying portion switches from the power applying condition to the non-power applying condition and when the downstream switching element is turned OFF from ON. A counter electromotive force generated in the coil is promptly distinguished by the arc extinguishing portion. Thus, an injector current which flows through the coil is decreased and the fuel injector is promptly opened.

Furthermore, the fuel injection controller has a detecting portion for measuring a decreasing electric current flowing through the coil from when the injector-drive-period is terminated and for detecting a characteristic of the fuel injector based on the measured electric current.

In a case that the detecting portion measures the decreasing electric current, the drive control portion delays a time point at which the downstream switching element is turned OFF relative to a time point at which the injector-drive-period is terminated.

And then, the electric-power supplying portion switches from the power applying condition to the non-power applying condition while the downstream switching element is ON. In this case, the electric current flows back to the coil through the refluxing portion without the function of the arc extinguishing portion.

For this reason, the electric current flowing through the coil is gradually decreased and its decreasing period is prolonged.

Therefore, the waveform of the electric current detected by the detecting portion becomes changeable according to a difference in characteristic of the fuel injector. As a result, a detection accuracy of the characteristic of the fuel injector can improved. Moreover, since the A-D converter is not always necessary to perform a high-speed operation, a cost increase of the fuel injection controller can be avoided.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Hereinafter an explanation will be made of fuel injection controller according to an embodiment in the present disclosure.

Figure 1:
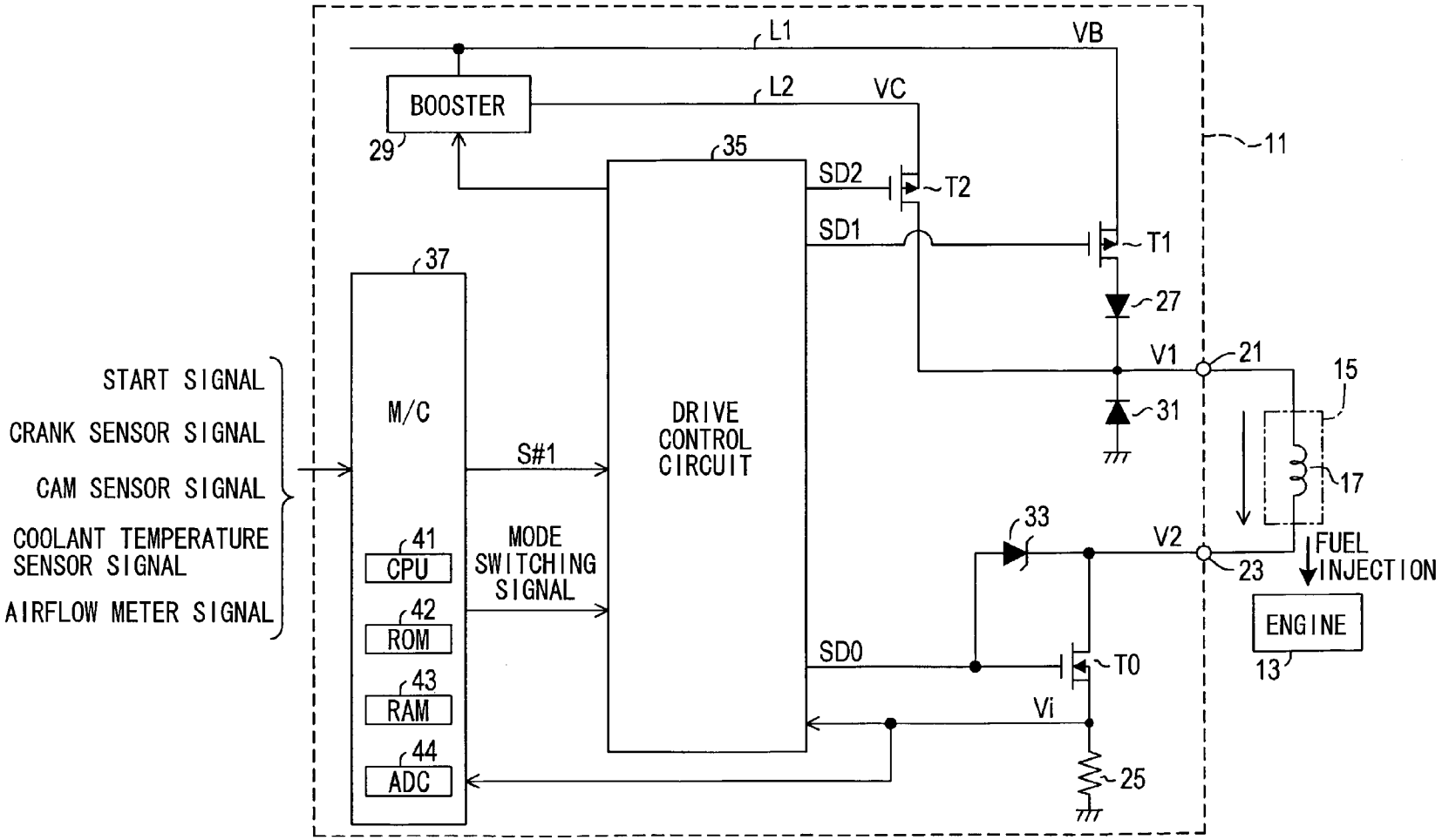
FIG. 1 is a schematic diagram showing a fuel injection controller according to an embodiment.

FIG. 1 shows a fuel injection controller 11 which drives each fuel injector 15. Each fuel injector 15 injects fuel into each cylinder of a multi-cylinder (for example, four-cylinder) internal combustion engine 13.

The fuel injector 15 is a solenoid-type fuel injector having a solenoid as an actuator for opening the fuel injector 15. That is, when a coil 17 of the solenoid is energized, the valve body moves to an opening position so that the fuel injector 15 injects the fuel. Meanwhile, when the coil 17 is deenergized, the valve body is moved to a closing position so that the fuel injector 15 terminates the fuel injection.

The fuel injection controller 11 controls a fuel injection quantity and a fuel injection time with respect to each cylinder of the engine 13 by controlling an energization time period and an energization start time of the coil 17 of each injector 15.

It should be noted that FIG. 1 shows only one fuel injector 15 corresponding to a first cylinder among the multiple fuel injectors 15. Moreover, in present embodiment, a transistor as a switching element is a MOSFET. Other than the MOSFET, a bipolar transistor may be used as the switching element.

As shown in FIG. 1, the fuel injection controller 11 is provided with: a first terminal 21 to which an upper end (upstream end) of the coil 17 of the fuel injector 15 is connected; a second terminal 23 to which a lower end (downstream end) of the coil 17 is connected; a transistor T0 as a downstream switching element of which an output terminal is connected to the second terminal 23; and resistor 25 for detecting an injector current. The resistor 25 is connected between another output of the transistor T0 and a ground line (line of ground potential).

Although it is not shown in drawings, the first terminal 21 functions as a common terminal of the fuel injector 15 of each cylinder. The coil 17 of each fuel injector 15 is connected to the first terminal 21. The second terminal 23 and the transistor T0 are provided to the coil 17 of each fuel injector 15. Moreover, since the transistor T0 functions as a switch selecting the subject fuel injector 15 for driving, the transistor T0 is referred to as a cylinder selecting switch. In the present embodiment, an N-channel type MOSFET is used as the transistor T0.

Moreover, a fuel injection controller 11 is with a transistor T1, a diode 27, a booster circuit 29 and a transistor T2. The transistor T1 is for constant current supply. One output terminal of the transistor T1 is connected to a power source line L1 to which a battery voltage VB is supplied. The diode 27 is for preventing a backflow. An anode is connected to the other output terminal of the transistor T1 and a cathode is connected to the first terminal 21. The booster circuit 29 boosts the battery voltage VB and outputs the voltage VC (>VB) for opening the fuel injector 15 promptly. The transistor T2 is for an inrush-current supply. One output terminal of the transistor T2 is connected to a power source line L2 to which the voltage VC from the booster circuit 29 is supplied. The other output terminal is connected to the first terminal 21. In present embodiment, P-channel type MOSFETs are used as the transistors T1 and T2.

Furthermore, the fuel injection controller 11 is provided with a diode 31, a Zener diode 33, a drive control circuit 35, and a microcomputer 37. The diode 31 is for refluxing. An anode is connected to the ground line and a cathode is connected to the first terminal 21. The Zener diode 33 is for arc extinguishing. A cathode is connected to the second terminal 23 and a drain of the transistor T0. An anode is connected to the gate of the transistor T0. The drive control circuit (drive control portion) 35 controls each of the transistors T0, T1, T2, and the booster circuit 29.

The diode 31 refluxes the electric current from the ground line which is downstream of the transistor T0 to upstream of the coil 17 when one of the transistors T1, T2 is turned OFF while the transistor T0 is ON.

The Zener diode 33 is provided to promptly consume the counter electromotive force generated in the coil 17 when one of the transistors T1 and T2 is turned OFF and the transistor T0 is turned OFF. At this moment, a driving signal SD0 transmitted form the drive control circuit 35 becomes "LOW" from "HIGH", and the transistor T0 will be turned OFF. However, a flyback voltage (reverse voltage) larger than the battery voltage VB is generated at the second terminal 23 by the electromagnetic energy accumulated in the coil 17, whereby Zener current flows from the cathode of the Zener diode 3 toward the anode of the Zener diode 3. When the Zener current flows, the gate voltage of the transistor T0 increases and the transistor T0 is turned ON in an active region. The electric current generated by the electromagnetic energy successively flows into the coil 17 through the transistor T0. Thus, the counter electromotive force is consumed by the transistor T0 mainly. The counter electromotive force promptly disappears and the injector current "I" flowing through the coil 17 is rapidly decreased. In a case that the Zener voltage of Zener diode 33 is denoted by "Vz" and a threshold of the gate voltage at which the transistor T0 is turned ON is denoted by "Vth", the downstream terminal voltage V2 at the second terminal 23 is denoted by "Vz+Vth", as shown by a dotted line in FIG. 4.

The microcomputer 37 is provided with a CPU 41, a ROM 42, a RAM 43 and an A-D converter (ADC) 44.

The microcomputer 37 receives: a start signal which becomes high-level when an engine start condition is established; a crank sensor signal transmitted from a crank sensor according to a rotation of a crankshaft of the engine 13; a cam sensor signal transmitted from a cam sensor according to a rotation of a camshaft of the engine 13; a coolant temperature sensor signal transmitted from a temperature sensor detecting an engine coolant temperature; and an airflow meter signal transmitted from an airflow meter detecting an intake air flow rate.

In the fuel injection controller 11, when an ignition switch is turned ON, the battery voltage VB is supplied to the source line L1 and a specified constant voltage (for example, 5V) is generated by a power supply circuit (not shown) for operating the microcomputer 37, the drive control circuit 35 and the like. Thus, when the ignition switch is turned ON, the microcomputer 37 is activated.

When the microcomputer 37 detects that the start signal has become high-level, the microcomputer 37 performs a cylinder-discrimination (identifying a rotating position of the crankshaft) based on the crank sensor signal and the cam sensor signal in order to determine a fuel injection time of each cylinder.

After the cylinder discrimination, the microcomputer 37 performs a fuel-injection-control processing, whereby the fuel injector 15 of each cylinder is controlled through the drive control circuit 35 based on a cylinder discrimination result, an engine speed computed based on the crank sensor signal, the water temperature sensor signal and the airflow meter signal.

Specifically, the microcomputer 37 determines whether a multi-stage injection will be performed with respect to each cylinder. When it is determined that the multi-stage injection will be performed, the microcomputer 37 determines the number of times of fuel injection in the multi-stage injection. Further, the microcomputer 37 determines an injection start time and an injection period with respect to each fuel injection. Then, based on the determined injection start time and the injection period, the microcomputer 37 generates an energization command signal and transmits this energization command signal to the drive control circuit 35.

While the energization command signal is at active level, the fuel injector 15 is driven. That is, the coil 17 of the fuel injector 15 is energized. Moreover, the injection start time corresponds to the driving starting time of the fuel injector 15, and the injection period corresponds to the drive time period of the fuel injector 15. For this reason, the energization command signal is made active level during the determined injection period. Therefore, the microcomputer (establishing portion) 37 establishes an injector-drive-period (driving starting time+drive time period) of the fuel injector 15 with respect to each cylinder based on the driving information, such as an engine speed. The microcomputer 37 makes the energization command signal HIGH with respect to the corresponding cylinder only in the injector-drive-period.

It should be noted that the multi-stage injection represents an injection in which the fuel required for one combustion in one cylinder is injected into the cylinder from the fuel injector 15 by dividing the injection multiple times. Also, the CPU 41 executes the program stored in the ROM 42, so that the microcomputer 37 operates as described above.

The booster circuit 29 is a well-known pressure-rise type DC-DC converter which performs a chopper control of the coil (inductor) in order to charge a capacitor with the flyback voltage generated in the coil.

In a case that all of the energization command signals of each cylinder from the microcomputer 37 are low (that is, during a period in which the injector 15 is not driven), the drive control circuit 35 operates the booster circuit 29 so that the output voltage VC of the booster circuit 29 (charging voltage of the capacitor) becomes a constant target voltage (for example, 80V).

Referring to a time chart shown in FIG. 2, a basic operation of the drive control circuit 35 will be explained hereinafter. As mentioned above, the drive control circuit 35 receives the energization command signal of each cylinder from the microcomputer 37. The following description regards the first cylinder as an example.

Figure 2:
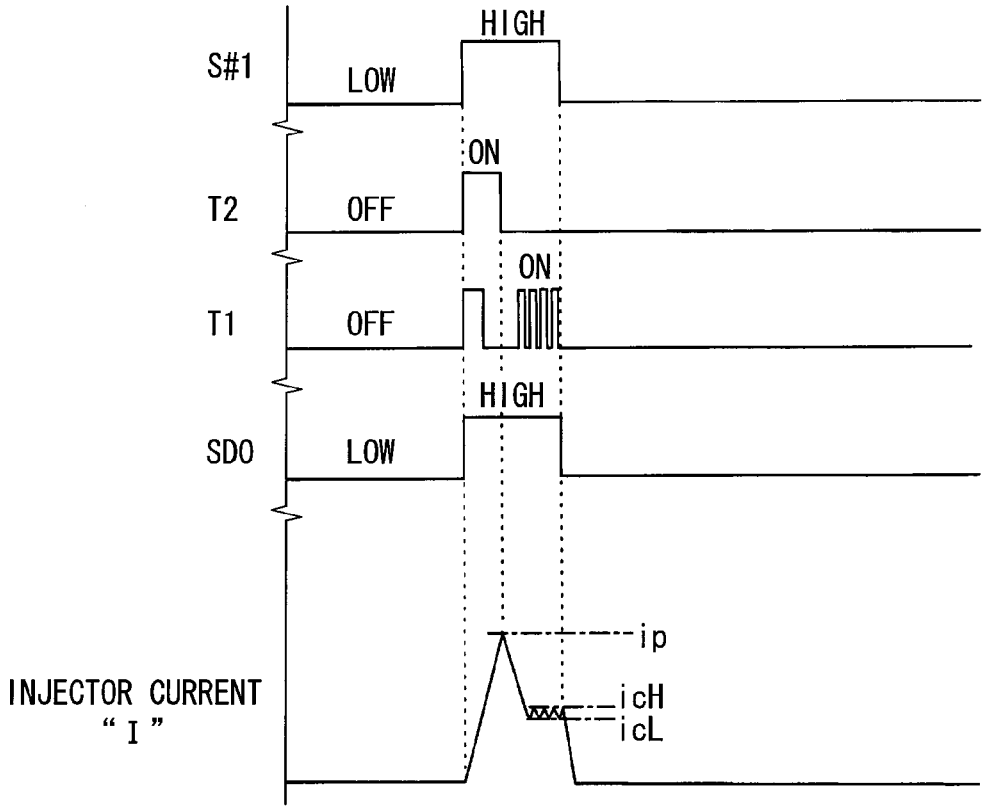
FIG. 2 is a time chart for explaining a basic operation of a drive control circuit.

As shown FIG. 2, when the energization command signal S#1 of the first cylinder transmitted from the microcomputer 37 to the drive control circuit 35 becomes HIGH from LOW, the drive control circuit 35 turns the driving signal SD0 of the transistor T0 corresponding to a first cylinder into HIGH, whereby the transistor T0 is turned ON and the drive control of the transistors T1 and T2 is started.

The drive control of the transistors T1 and T2 is comprised of an inrush-current control and a constant current control, which will be described later.

In the present embodiment, since the transistor T1 is a P-channel-type MOSFET, the drive control circuit 35 turns ON the transistor T1 by turning the driving signal SD1 into LOW, and turns OFF transistor T1 by turning the driving signal SD1 into HIGH. Similarly, since the transistor T2 is also a P-channel-type MOSFET, the drive control circuit 35 turns ON the transistor T2 by turning the driving signal SD2 into LOW, and turns OFF transistor T2 by turning the driving signal SD2 into HIGH.

(1) Inrush-Current Control

When the energization command signal S#1 becomes HIGH from LOW, the drive control circuit 35 starts the inrush-current control in which the transistor T2 is turned ON first.

Then, the voltage VC from the booster circuit 29 is applied to the first terminal 21 and the coil 17 of the fuel injector 15, whereby an energization of the coil 17 is started. At this moment, as shown in the lowest part of FIG. 2, the inrush current for promptly making the fuel injector 15 opened flows through the coil 17.

Then, after the drive control circuit 35 turns ON the transistor T2, the driving circuit 35 detects the injector current "I" based on the voltage Vi generated in the resistor 25. When the detected injector current "I" reaches a peak value "ip" previously established in the drive control circuit 35, the drive control circuit 35 turns OFF the transistor T2.

According to the above inrush-current control, when the energization of the coil 17 is started, the transistor T2 is turned ON and the voltage VC higher than battery voltage VB is applied to the upstream of the coil 17, whereby the valve-open response of the fuel injector 15 is enhanced.

(2) Constant Current Control

When the energization command signal S#1 becomes HIGH from LOW, the drive control circuit 35 starts the constant current control for supplying a constant current to the coil 17. In the constant current control, the transistor T1 is turned ON and OFF in such a manner that the injector current "I" detected based on the voltage Vi generated in the resistor 25 becomes a constant current smaller than the peak value "ip".

As shown in FIG. 2, when the injector current "I" becomes less than or equal to a lower threshold "icL", the transistor T1 is turned ON. When the injector current "I" becomes greater than or equal to an upper threshold "icH", the transistor T1 is turned OFF. It should be noted that a relationship between the lower threshold "icL", the upper threshold "icH", and the peak value "ip" is represented as follows: "icL<icH<ip."

When the injector current "I" falls from the peak value "ip" and becomes less than or equal to the lower threshold "icL" along with the turning OFF of the transistor T2, the transistor T1 is repeatedly turned ON and OFF according to the constant current control. An average value of injector current "I" is adjusted to a constant current between the upper threshold "icH" and the lower threshold "icL". When the transistor T1 is ON, the battery voltage VB is applied to the upstream of the coil 17 as a source voltage. The electric current flows into the coil 17 through the transistor T1 and the diode 27. When the transistor T1 is OFF, the electric current (reflux current) flows into the coil 17 from the ground line through the diode 31.

According to the constant current control, after the transistor T2 is turned OFF, a constant current flows through the coil 17, whereby the fuel injector 15 is held opened.

It should be noted that the transistor T1 is ON for a short period after the energization command signal S#1 became HIGH, as shown in FIG. 2. This phenomenon is due to the constant current control. That is, the transistor T1 is continuously ON after the energization command signal S#1 becomes HIGH until the injector current "I" reaches the upper threshold "icH". Since the voltage VC from the booster circuit 29 is greater than the battery voltage VB, the electric current flows through the coil 17 while the transistor T2 is ON even though the transistor T1 is turned ON. For this reason, even if the constant current control is started when the injector current "I" falls to the lower threshold "icL" after the transistor T2 is turned OFF by the inrush-current control, the control result is same.

FIG. 2 shows a case in which the lower threshold "icL" and the upper threshold "icH" are always constant and the injector current "I" is adjusted to one kind of constant current. However, when a specified time has elapsed after the energization of the coil 17 is started, the lower threshold "icL" and the upper threshold "icH" may be changed to smaller values and the injector current "I" may be adjusted to a lower constant current.

After that, when the energization command signal S#1 from the microcomputer 37 becomes LOW from HIGH, the drive control circuit 35 terminates the drive control of the transistors T1 and T2. The transistor T1 and T2 are kept OFF. At the same time, the drive control circuit 35 turns the driving signal SD0 to LOW, and the transistor T0 is turned OFF.

Then, the coil 17 is deenergized and the injector 15 is closed. The fuel injection by the injector 15 is terminated.

Moreover, when the energization command signal S#1 becomes LOW from HIGH and the drive control circuit 35 terminates the drive control of the transistors T1, T2 and turns OFF the transistor T0, one of the transistors T1 and T2 which has been ON is turned OFF and the transistor T0 is turned OFF. Therefore, as mentioned above, the transistor T0 is turned ON in the active region by the Zener diode 33, so that the counter electromotive force of the coil 17 is consumed promptly.

A specific configuration of the fuel injection controller 11 will be described hereinafter.

As shown in FIG. 1, the drive control circuit 35 receives a mode switching signal from the microcomputer 37. When the mode switching signal indicates a normal mode (LOW level, for example), the drive control circuit 35 performs the above-mentioned basic operation. When the mode switching signal indicates a characteristic-detection mode (HIGH level) for detecting the characteristic of the fuel injector 15, the drive control circuit 35 performs an operation slightly different from the basic operation.

Figure 3:
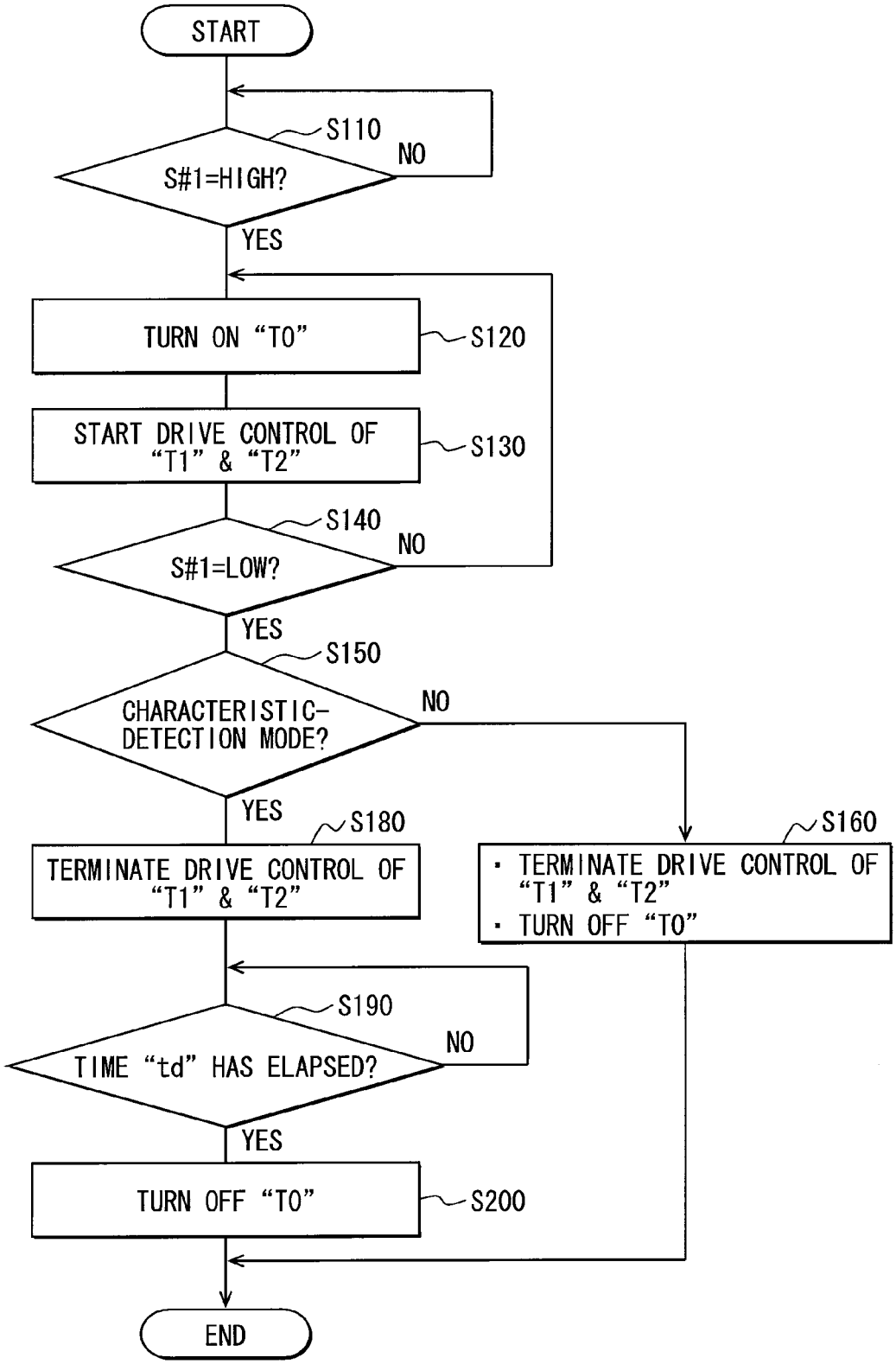
FIG. 3 is a flow chart for explaining an operation of the drive control circuit.

Referring to FIG. 3, an operation of the drive control circuit 35 will be explained, hereinafter.

FIG. 3 is a flowchart showing the operation of the drive control circuit 35. When the drive control circuit 35 detects that the energization command signal S#1 became HIGH from LOW (S110: YES), the transistor T0 is turned ON (S120) and the drive control (inrush-current control and constant current control) of the transistors T1 and T2 is started (S130).

Then, when the drive control circuit 35 detects that the energization command signal S#1 became LOW (S140: YES), the drive control circuit 35 determines whether the mode switching signal indicates the characteristic-detection mode (HIGH level) in S150.

When the mode switching signal indicates the normal mode (S150: NO), the drive control circuit 35 terminates the drive control of the transistors T1 and T2 and turns OFF the transistor T0 (S160).

That is, the operations in S110-S140 and S160 correspond to the operations in the normal mode, that is, the basic operation.

Meanwhile, when the drive control circuit 35 detects that the energization command signal S#1 became LOW (S140: YES) and the mode switching signal indicates the characteristic-detection mode (S150: YES), the drive control circuit 35 terminates the drive control of the transistors T1 and T2 without turning OFF the transistor T0 (S180). Then, when a specified time "td" has elapsed after the energization command signal S#1 becomes LOW (S190: YES), the transistor T0 is turned OFF (S200).

Figure 4:
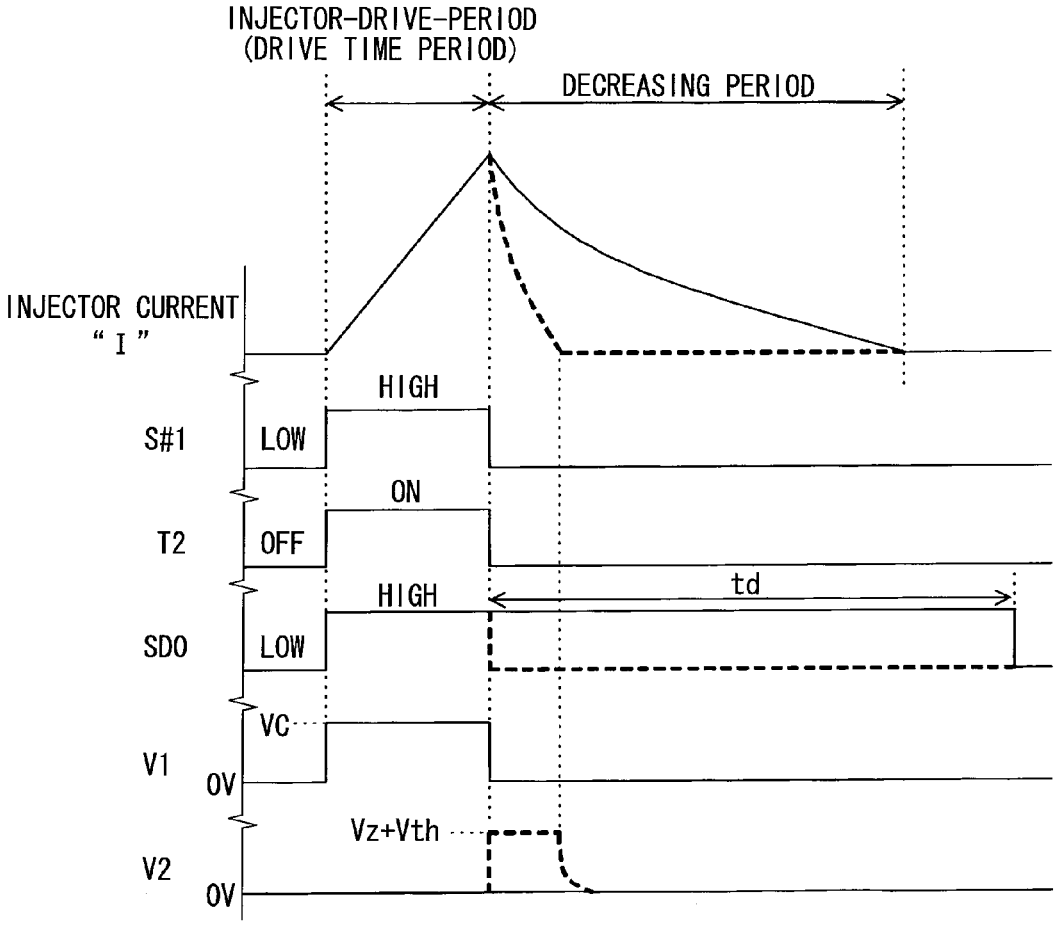
FIG. 4 is a time chart for explaining a operation of the drive control circuit in a characteristic-detection mode.

That is, when the mode switching signal indicates the characteristic-detection mode, the drive control circuit 35 delays a time point at which the transistor T0 is turned OFF by the specified time "td" relative to a falling time of the energization command signal S#1, as shown in FIG. 4. The time point at which the transistor T0 is turned OFF corresponds to a time point at which the driving signal SD0 becomes LOW from HIGH. The falling time of the energization command signal S#1 corresponds to a time point at which the injector-drive-period of the fuel injector 15 is terminated.

When the drive control circuit 35 delays the OFF-time of the transistor T0 relative to the falling time of the energization command signal S#1, one of the transistors T1 and T2 which has been ON is turned OFF while the transistor T0 is ON. Therefore, the electric current flows back to the coil 17 through the diode 31 without the function of the Zener diode 33.

In FIG. 4, the waveform shown by a dotted line is a waveform of when the drive control circuit 35 performs basic operation (normal mode). In this case, immediately after the driving signal SD0 is changed from HIGH to LOW, the transistor T0 is turned ON in the active region by the Zener diode 33 and the counter electromotive force of the coil 17 promptly disappears. Thus, the injector current "I" rapidly decreases. As mentioned above, the period in which the downstream terminal voltage V2 is "Vz+Vth" corresponds to a period in which the transistor T0 is ON in the active region.

On the other hand, as a waveform shown by a solid line in FIG. 4 indicates, when the drive control circuit 35 delays the OFF-time of the transistor T0 relative to the falling time of the energization command signal S#1, the injector current "I" decreases more gradually than the case of the basic operation. Thus, a time period from the falling time of the energization command signal S#1 until a time point at which the injector current "I" becomes zero is prolonged. In the present embodiment, the above-mentioned specified time "td" is established longer than the maximum time period from the falling time of the energization command signal S#1 until a time point at which the injector current "I" becomes zero. For this reason, as shown in FIG. 4, when driving signal SD0 is turned LOW from HIGH, the injector current "I" is zero.

In FIG. 4, "upstream terminal voltage V1" corresponds to the voltage at the first terminal 21.

FIG. 4 shows a case in which the drive time period of the fuel injector 15 is very short and the energization command signal S#1 becomes LOW before the energization command signal S#1 becomes HIGH and the injector current "I" reaches the peak value "ip". For this reason, in the case shown in FIG. 4, the transistor T2 is turned OFF at the falling time of the energization command signal S#1 and the transistor T0 is turned OFF when the specified time "td" has passed since then. On the other hand, when the energization command signal S#1 is turned LOW in a period in which the transistor T1 is turned ON and OFF according to the above-mentioned constant current control, the constant current control is terminated at the falling time of the energization command signal S#1 and the transistor T1 is no longer turned ON. When the specified time "td" has passed since then, the transistor T0 is turned OFF.

Figure 5:
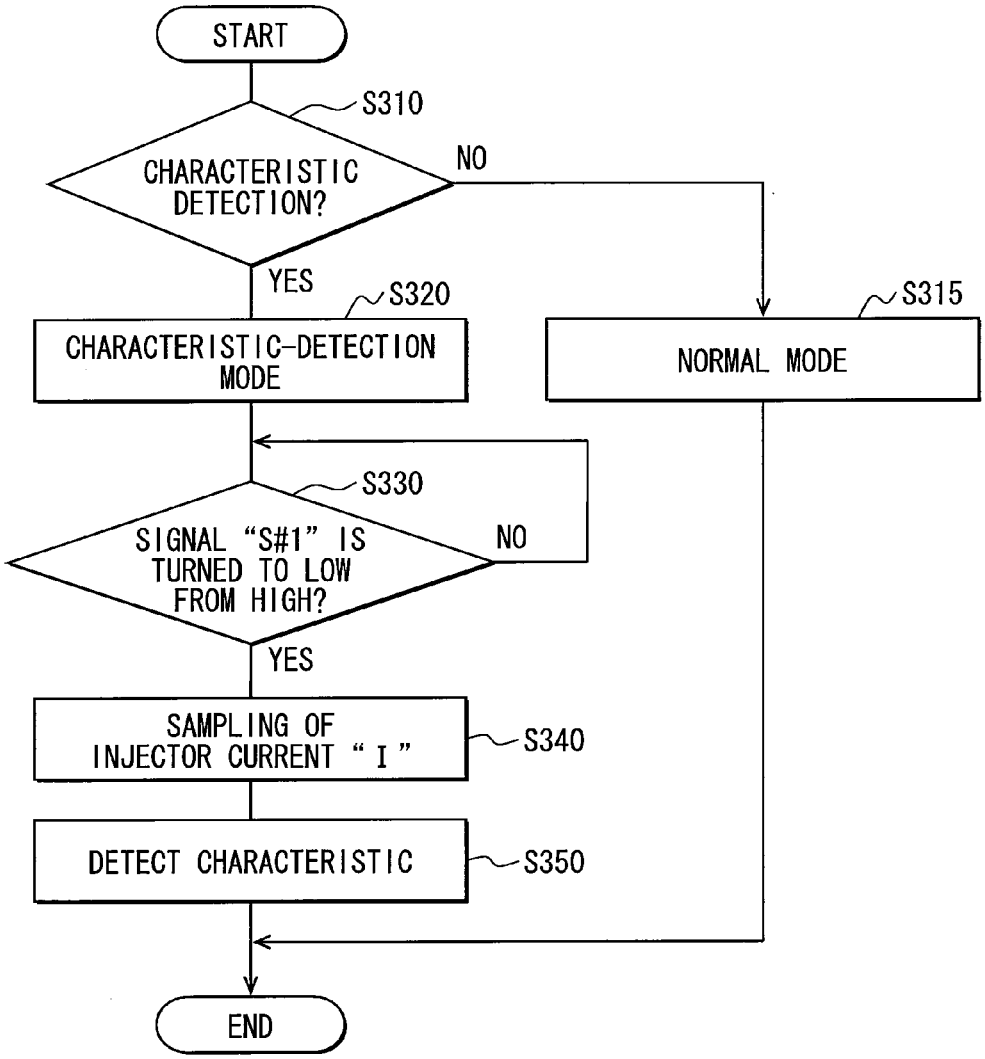
FIG. 5 is a flow chart showing a characteristic-detection processing which a microcomputer performs.

The microcomputer 37 performs the characteristic-detection processing shown in FIG. 5 for detecting the characteristic of the fuel injector 15. This characteristic-detection processing is performed immediately before the fuel injection is started and the energization command signal is turned HIGH. FIG. 5 is a flowchart showing the characteristic-detection processing with respect to the fuel injector 15 provided to the first cylinder. The characteristic-detection processing is performed before the energization command signal S#1 is turned HIGH.

In S310, the microcomputer 37 determines whether the characteristic-detection of the fuel injector 15 will be performed. When the microcomputer 37 determines that the characteristic-detection of the fuel injector 15 will not be performed, the procedure proceeds to S315.

In S315, the microcomputer 37 establishes the mode switching signal to the drive control circuit 35 as the above-mentioned normal mode, whereby the operation mode of the drive control circuit 35 is established as the normal mode to end the characteristic-detection processing.

Meanwhile, when the microcomputer 37 determines that the characteristic-detection of the fuel injector 15 will be performed in S310, the procedure proceeds to S320 in which the mode switching signal is established so as to perform the characteristic detection of the fuel injector 15, whereby the operational mode of the drive control circuit 35 is established as the characteristic-detection mode.

Then, the procedure proceeds to S330 in which it waits until the falling time of the energization command signal S#1 comes. The falling time of the energization command signal S#1 corresponds to a time at which the energization command signal S#1 is turned to LOW from HIGH and the injector-drive-period of the injector 15 ends. When the falling time of the energization command signal S#1 has come, the procedure proceeds to S340.

A sampling of the injector current "I" is started in S340. Specifically, in the present embodiment, since the voltage "Vi" generated in the resistor 25 is detected as the injector current "I", the voltage "Vi" is A-D converted by an A-D converter 44 at a specified time interval and each of A-D converted values is sequentially stored in the RAM 43.

It should be noted the sampling of the injector current "I" is continued until it is determined that the injector current "I" becomes zero. Alternatively, the sampling of the injector current "I" is continued until the specified time "td" has elapsed. Moreover, by performing the sampling of the injector current "I", the injector current "I" decreasing from the termination of the injector-drive-period of the fuel injector 15 can be measured.

When the injector current "I" becomes zero, the microcomputer 37 terminates the sampling. The procedure proceeds to S350.

In S350, the microcomputer 37 computes the characteristic of the fuel injector 15 based on the A/D converted values stored in the RAM 43. Then, the microcomputer 37 terminates the characteristic-detection processing.

The processing in S350 will be explained more in detail, hereinafter. According to the present embodiment, each A/D converted value stored in the RAM 43 is integrated, whereby the integrated value of the decreasing injector current "I" is obtained. Based on the integrated value of the injector current "I", the microcomputer 37 detects an inductance of the coil 17 as the characteristic of the fuel injector 15.

More specifically, the ROM 42 stores a data map for computing the inductance of the fuel injector 15 based on the drive time period of the fuel injector 15 (energization command signal is HIGH) and the integrated value of the decreasing injector current "I". In S350, the drive time period of the fuel injector 15 and the injector current "I" are applied to the above data map. Further, an interpolating calculation is executed to compute the inductance.

Even though the inductance of the fuel injector 15 is constant, the integrated value of the injector current "I" varies according to the injector current "I" of when the injector-drive-period of the fuel injector 15 is terminated. Moreover, since the injector current "I" of when the injector-drive-period terminates varies according to the drive time period of the fuel injector 15, not only the integrated value but also the drive time period of the fuel injector 15 is employed as a parameter for computing the inductance, according to the present embodiment. Besides, the data map for computing the inductance can be established by a theoretical calculation or an experiment.

As a modification, instead of the drive time period, the injector current "I" at the time when the injector-drive-period is terminated can be employed as a parameter for computing the inductance. In this case, the data map for computing the inductance can be established based on the injector current "I" of when the injector-drive-period terminates and the integrated value of decreasing injector current "I". The microcomputer 37 stores the first A/D conversion value of when the sampling of injector current "I" is started in S340 as the injector current "I" of when the injector-drive-period is terminated. The stored injector current "I" and the computed integrated value are applied to the data map, whereby the inductance is computed.

In a case that the characteristic detection of the fuel injector 15 is performed, when it is assured that the injector current "I" is constant at the time of termination of the injector-drive-period, the data map does not always need the drive time period as a parameter. The inductance can be computed based on the integrated value of the increasing injector current "I".

When the inductance of the fuel injector 15 is varied, the other characteristic are also varied. For example, a delay time (valve-close delay time) from when the injector-drive-period is terminated until when the fuel injector 15 is actually closed is varied. For this reason, according to the present embodiment, the data map for computing the valve-close delay time based on the inductance is stored in the ROM 42. Besides, the data map for computing the valve-close delay time can be established by a theoretical calculation or an experiment.

Then microcomputer 37 applies the inductance computed in S350 to the data map for computing the valve-close delay times. Further, the microcomputer 37 performs the interpolating calculation to compute the valve-close delay time of the fuel injector 15.

When the microcomputer 37 determines the drive time period (injection period) of the fuel injector 15 provided to the first cylinder in the fuel-injection-control processing, the microcomputer 37 corrects a basic value of the drive time period computed based on engine driving information, such as engine speed, based on the valve-close delay time of the fuel injector 15 provided to the first cylinder, whereby the drive time period for obtaining the fuel injection quantity is computed. Specifically, a difference (tc−tr) between the computed valve-close delay time "tc" and a standard value "tr" of the valve-close delay time is computed. The basic value of the drive time period is shortened by a time corresponding to the difference (tc−tr). Then, the obtained value is established as the drive time period actually used for driving the fuel injector 15. It should be noted that the difference (tc−tr) is an individual difference of the fuel injector 15. In the drive time period, the energization command signal is HIGH.

The above described operation is performed in the fuel injectors 15 provided to the cylinders other than the first cylinder. According to the fuel injection controller 11 of the present embodiment, when the microcomputer 37 performs the sampling of the injector current "I" decreasing from a time of the termination of an injector-drive-period, the drive control circuit 35 delays the OFF time of the transistor T0 relative to the time of termination of the injector-drive-period. Thus, the injector current "I" gradually decreases and the decreasing period of the injector current "I" is prolonged.

Therefore, the waveform of the injector current "I" which the microcomputer 37 measures by sampling becomes changeable according to the difference of the characteristic of the fuel injector 15. According to the present embodiment, and the integrated value of the injector current "I" becomes changeable according to the inductance of the fuel injector 15. As a result, the detection accuracy of the inductance can be improved. Moreover, since the A-D converter 44 is not always necessary to perform a high-speed operation, a cost increase of the fuel injection controller 11 can be avoided.

In S310 of the characteristic-detection processing shown in FIG. 5, it can be configured that the characteristic detection of the fuel injector 15 can be performed with respect to every fuel injections.

Moreover, in S310 of the characteristic-detection processing, it can be configured that the microcomputer 37 can perform the characteristic detection of the fuel injector 15 when a part of fuel injection among the multi-stage injections is conducted. According to the above configuration, it is desirable in the followings.

That is, in a case that the sampling of the injector current "I" is performed for detecting the characteristic of the fuel injector 15, the injector current "I" gradually decreases and the valve-close time of the fuel injector 15 is delayed than usual. The actual fuel injection quantity also increases. For this reason, among multi-stage injections, with respect to other injections to which the characteristic detection of the fuel injector 15 is not performed, the drive time period of the fuel injector 15 is corrected to be shorter, whereby the total fuel injection quantity by the multi-stage injection can become the same as the case where characteristic detection is not performed. That is, no influence occurs in the combustion and emission of the engine 13 due to the characteristics detection.

Especially, in S310 of the characteristic-detection processing, it is preferable that the microcomputer 37 performs the characteristic detection of the fuel injector 15 when a last fuel injection among the multi-stage injections is conducted.

Regarding the last fuel injection among the multi-stage injections, a time interval between the current injection and the successive injection with respect to the specific cylinder is significantly longer than that of the multi-stage injection. Thus, even if the decreasing period of the injector current "I" is prolonged for performing the characteristic detection of the fuel injector 15, no influence occurs in the successive fuel injection.

The preferred embodiments are described above. The present disclosure is not limited to the above embodiments.

For example, the characteristic of the fuel injector 15 is not limited to the inductance. Other kinds of characteristic may be employed as the characteristic of the fuel injector 15 An example in which the valve-close delay time is directly detected not from the inductance will be described.

Generally, it is known that the injector current "I" rapidly decreases at a valve-close time of the fuel injector 15. For this reason, for example, in S350 of FIG. 5, the time differential values of the A/D converted values stored in the RAM 43 are computed. A time point corresponding to the time differential value at which the change tendency changes to an increase or at which the differential value starts decreasing from zero can be detected as the valve-close time of the injector 15. A time period from the termination of the injector-drive-period until the detected valve-close time can be computed as the valve-close delay time of the fuel injector 15.

For arc extinguishing, a Zener diode of which cathode is connected to both the second terminal 23 and a drain of the transistor T0 and anode is connected to a source or a grand line of the transistor T0 can be used. In this case, the counter electromotive force of the coil 17 will be consumed by this Zener diode.

In the above embodiments, as an electric-power supplying portion applying the source voltage to the upstream of the coil 17, two transistors T1 and T2 are provided. When any one of the transistors T1 and T2 is turned ON, the source voltage is applied to the coil 17 (power applying condition). Both of the transistors T1 and T2 are turned OFF, the source voltage is not applied to the coil 17 (non-power applying condition). Meanwhile, the present disclosure can be applied to a case in which only one of the transistors T1 and T2 is provided.

What is claimed is:

1. A fuel injection controller comprising:

a downstream switching element provided in an energizing path for supplying an electric current to a coil of a fuel injector, the downstream switching element provided downstream of the coil in series;

an electric-power supplying portion which can switch between a power applying condition in which a source voltage is applied to an upstream of the coil in the energizing path and a non-power applying condition in which no source voltage is applied to the upstream of the coil in the energizing path;

a refluxing portion for refluxing the electric current from a downstream of the downstream switching element to an upstream of the coil when the electric-power supplying portion switches from the power applying condition to the non-power applying condition while the downstream switching element is ON;

an arc extinguishing portion for extinguishing a counter electromotive force generated in the coil when the electric-power supplying portion switches from the power applying condition to the non-power applying condition and when the downstream switching element is turned OFF from ON;

an establishing portion for establishing an injector-drive-period of the fuel injector;

a drive control portion controls the electric-power supplying portion to be the power applying condition when the injector-drive-period is started, the drive control portion turning ON the downstream switching element for starting an energization of the coil to open the fuel injector, the drive control portion controlling the electric-power supplying portion to be the non-power applying condition when the injector-drive-period is terminated, the drive control portion turning OFF the downstream switching element for terminating the energization of the coil to close the fuel injector, and a detecting portion for measuring a decreasing electric current flowing through the coil from when a the injector-drive-period is terminated and for detecting a characteristic of the fuel injector based on the measured electric current, wherein in a case that the detecting portion measures the decreasing electric current, the drive control portion delays a time point at which the downstream switching element is turned OFF relative to a time point at which the injector-drive-period is terminated.

2. A fuel injection controller according to claim 1, wherein the fuel injector injects a fuel into a cylinder of an internal combustion engine when opened, the fuel required for one combustion in one cylinder is injected into the cylinder from the fuel injector by dividing the injection multiple times, and a detecting portion measures the decreasing electric current when a part of fuel injection among multiple injections is conducted.

3. A fuel injection controller according to claim 2, wherein a detecting portion measures the decreasing electric current when a last fuel injection among multiple injections is conducted.

* * * * *